US006012501A

United States Patent [19]

Marschke

[11] Patent Number: 6,012,501

[45] **Date of Patent: *Jan. 11, 2000**

[54] SINGLE FACER WITH SMALL INTERMEDIATE CORRUGATING ROLL AND VARIABLE WRAP ARM DEVICE

[75] Inventor: Carl R. Marschke, Phillips, Wis.

[73] Assignee: Marquip, Inc., Phillips, Wis.

[ * ] Notice: This patent is subject to a terminal disclaimer.

[21] Appl. No.: 09/044,516

[22] Filed: Mar. 19, 1998

Related U.S. Application Data

[63] Continuation-in-part of application No. 08/854,953, May 13, 1997, which is a continuation-in-part of application No. 08/621,998, Mar. 26, 1996, Pat. No. 5,628,865.

[51] Int. Cl.[7] ..... B31F 1/00; B31F 1/20

[52] U.S. Cl. ..... 156/472; 156/473; 156/210

[58] Field of Search ..... 156/210, 205, 156/471, 472, 473, 462

[56] References Cited

U.S. PATENT DOCUMENTS

| | | | |
|---|---|---|---|
| 1,519,280 | 12/1924 | Wandel | 156/205 |
| 2,102,937 | 12/1937 | Bauer | 134/23.4 |
| 2,977,247 | 3/1961 | Lutz | 117/111 |
| 3,382,133 | 5/1968 | Healy . | |
| 5,389,183 | 2/1995 | Seki et al. | 156/359 |
| 5,728,256 | 3/1998 | Schulz et al. | 156/472 |

*Primary Examiner*—Michael W. Ball
*Assistant Examiner*—R. Hendrix
*Attorney, Agent, or Firm*—Andrus, Sceales, Starke & Sawall

[57] ABSTRACT

The labyrinth path in the corrugating nip of a single facer is substantially reduced by utilizing a small diameter corrugating roll captured between a larger diameter conventional corrugating roll and a backing roll arrangement. The smaller diameter corrugating roll is captured to prevent bending thereof under corrugating loads. The corrugator may be operated at high speeds without the adverse increase in labyrinth path and web tension characteristic of a pair of large diameter corrugating rolls.

7 Claims, 5 Drawing Sheets

36
33
12
42
42
29
28
25
26
27
11
24

12
38
36
42
38
33
40
45
7
7'
16
23

50
52
57
56
53
28
54
52
56
56
56
56
25
26
23
24
11
16
12
42
38
45
40
36
33

SINGLE FACER WITH SMALL INTERMEDIATE CORRUGATING ROLL AND VARIABLE WRAP ARM DEVICE

CROSS REFERENCES TO RELATED APPLICATIONS

This application is a continuation-in-part of Ser. No. 08/854,953, filed May 13, 1997, which is a continuation-in-part of Ser. No. 08/621,998, filed Mar. 26, 1996, now U.S. Pat. No. 5,628,865.

BACKGROUND OF THE INVENTION

The present invention pertains to an apparatus for forming a single face web of corrugated paperboard and, more particularly, to a corrugating roll assembly for a single facer.

In the manufacture of corrugated paperboard, a single facer apparatus is used to corrugate the medium web, apply glue to the flute tips on one face thereof, and to bring a liner web into contact with the glued flute tips of the medium web with the application of sufficient heat and pressure to provide an initial bond. A conventional single facer typically includes a pair of fluted corrugating rolls and a pressure roll, which are aligned so the axes of all three rolls are generally coplanar. The medium web is fed between the inter-engaging corrugating rolls and the adhesive is applied to the flute tips by a glue roll while the medium is still on the corrugating roll which comprises the intermediate of the three roll arrangement. The liner web is immediately thereafter brought into contact with the adhesive-coated flute tips in the nip between the pressure roll and the corrugating roll.

As corrugating nip roll pressures and corrugating speeds have increased, changes have been made in the construction of single facers to maintain the quality of the corrugated medium and to attempt to deal with the problems of high noise and vibration. For example, the load between corrugating rolls at the corrugating nip has required that one of the fluted corrugating rolls be made with a crowned surface to accommodate roll deflection under high nip loads. Deflection as a result of high loading is also believed to be one source of noise and vibration. In a conventional single facer construction, where the two corrugating rolls and the lower pressure roll are in general alignment (their axes lying generally coplanar), corrugating roll loads are transmitted to the pressure roll adding further to the problems associated with high loads and high speeds. This has resulted, in some cases, in manufacturing the pressure roll with a negative crown to match deflections in the corrugating roll which together form the nip for joining the two single face web components.

One of the most serious problems in the operation of high speed single facers is the so-called "labyrinth" effect. In order to handle high loads and higher speeds, single facer manufacturers have gone to increasingly larger diameter, heavier and stronger corrugating rolls. As the medium web is drawn into the pressure nip, formed by the inter-engaging flutes on the two corrugating rolls, the medium web begins to be deformed, folded and gathered as it moves into the actual nip centerline where full engagement of the flutes occurs. Larger diameter corrugating rolls inherently create a more tortuous path for the web as the web begins to be wrapped partially around opposite alternating teeth or flutes of the mating corrugating rolls while moving into the fully nipped position. Each wrap of the web encompasses a slightly larger radius around the flute tip as it approaches the nip and each deformation or wrapping of the web on a flute tip adds a tension component to the overall web tension. As indicated, the additive labyrinth effect is increased as the corrugating roll diameters increase and it is not uncommon for the medium web to rupture or tear.

One proposed solution to the labyrinth problem is disclosed in U.S. Pat. No. 3,990,935. The single facer construction disclosed in this patent proposes to maintain relatively small diameter corrugating rolls to minimize the labyrinth length and to provide internally pressurized flexure compensation for the inevitable bowing to which the rolls are subjected under high corrugating nip loads. Another proposed solution to the labyrinth effect is described in U.S. Pat. No. 4,531,996. In accordance with this patent, the upper corrugating roll contact with the lower corrugating roll is "dephased" by dividing the upper roll into axially adjacent segments each of which makes nip contact with the other corrugating roll at a different point. Alternately, the dephasing effect is provided by making the segments of the upper corrugating roll of different diameters. Both of the foregoing solutions require extremely complex roll constructions. Alternately, one of the larger diameter corrugating rolls may be eliminated and other means used to stabilize a small diameter intermediate corrugating roll to provide the required nip force and prevent deflection of the small roll.

SUMMARY OF THE INVENTION

In accordance with the present invention, the labyrinth effect is minimized in a modified single facer by utilizing a small diameter corrugating roll and a larger diameter conventional corrugating roll and capturing the small diameter roll in a manner to balance the loadings and minimize roll deflection.

In accordance with one embodiment, a single facer utilizes a pair of conventional fluted main corrugating rolls mounted and operated to impose a corrugating nip force acting normal to the roll axes and generally in the plane common thereto. An intermediate fluted corrugating roll is mounted between and in rotatable engagement with both main corrugating rolls and with its axis lying generally in the same common plane. The intermediate roll forms the corrugating nip with one of the main corrugating rolls and has a diameter, as compared to the main corrugating rolls, sufficiently small to provide a reduction in the labyrinth paper path sufficient to prevent rupture of the medium web. By capturing the intermediate web corrugating roll between the two main corrugating rolls, the nip force acts to hold the smaller intermediate roll against axial bending in the common plane of their axes.

A significant reduction in the labyrinth path of the web is effected by maintaining the ratio of the diameter of the main corrugating roll and the intermediate corrugating roll which together form the nip not less than about 3:1. Preferably, one or both of the main corrugating rolls are heated and the intermediate corrugating roll may be heated as well.

The apparatus may be constructed to wrap the corrugated medium on the intermediate corrugating roll downstream of the corrugating nip to the line of engagement between the intermediate roll and the other main corrugating roll, and then back wrapped on the other main corrugating roll downstream to the point of joinder with the liner web in the pressure nip. Preferably, the intermediate corrugating roll and the other or lower corrugating roll include means for applying a vacuum to the portions of the corrugated medium wrapped thereon. The apparatus may include a liner delivery roll of any common construction mounted in operative rotational contact with the main corrugating roll carrying the corrugated medium. The liner delivery roll carries a liner web and forms with the main corrugating roll a nip to join the liner web to the corrugated medium to the flute tips of which a suitable adhesive has been applied.

In a presently preferred embodiment of the single facer of the subject invention, only one large diameter fluted corrugating roll is utilized. The small diameter fluted corrugating roll, preferably having a diameter not greater than about one-third the diameter of the large corrugating roll is positioned to interengage the large roll to create therewith a corrugating nip. In place of the other large diameter corrugating roll of the previously described embodiment, means are provided for applying a radial force to the small diameter roll generally along the axial length thereof with the resultant of the radial force creating a nip force which acts through the corrugating nip in a plane generally common to the axes of the corrugating rolls. The radial backing force also acts to restrain the small diameter roll against deflection in a manner similar to the upper of the two large corrugating rolls in the previous embodiment.

In accordance with one embodiment of the invention, the force applying means comprises an idler roll means which rotatably engages the small diameter corrugating roll. The idler roll means may comprise a resilient roll or rolls having a smooth outer surface in engagement with the fluted small diameter corrugating roll. Alternately, the idler roll means may comprise a fluted idler roll adapted to interengage the flutes of the small diameter corrugating roll. In the preferred embodiment, the idler roll means comprises pairs of idler rolls which are positioned along the length of the small diameter corrugating roll. The rolls of each pair are mounted on opposite sides of the plane generally common to the axes of the two corrugating rolls. Each pair of idler rolls includes its own interconnecting support. An actuator is operatively connected to each backing roll support to supply the necessary nip force. Means are provided for individually operating each actuator to vary the force applied by the idler rolls to the small diameter corrugating roll.

In accordance with the preferred embodiment of the present invention, the backing roll arrangement includes pairs of idler rolls each having a pressure belt entrained around each pair of idler rolls. The pairs of idler rolls are positioned along the axial length of the small diameter corrugation roll. The idler rolls of each pair are mounted on opposite sides of the plane generally common to the axes of the two corrugating rolls. A pressure belt is entrained around each pair of idler rolls such that the portion of the belt suspended between the idler rolls can be moved into contact with the fluted small diameter corrugating roll. Each pair of idler rolls includes its own interconnecting support assembly.

An actuator is operatively connected to each idler roll support assembly to supply the necessary nip force between the pressure belt and the small diameter corrugating roll. Means are provided for individually operating each actuator to vary the force applied by the pressure belts to the small diameter corrugating roll. Each pressure belt may comprise a belt having a smooth outer surface for engagement with the fluted small diameter corrugating roll. Alternatively, the pressure belt may include a fluted outer surface adapted to interengage the flutes of the small diameter corrugating roll.

The apparatus of the preferred embodiment may be constructed to include a wrap arm device that functions to vary the amount of circumferential wrap of the freshly glued single face corrugated web around the large diameter heated corrugating roll. The wrap arm device includes a pair of wrap arms that is attached to an idler wrapping roll on one end. The pair of wrap arms suspends the idler wrapping roll along an axis parallel to the axis of the large diameter corrugating roll. Each of the wrap arms are pivotally mounted about an end opposite the idler wrapping roll such that the pivoting movement of the wrap arms move the idler wrapping roll toward and away from the large diameter corrugating roll. By moving the idler wrapping roll in this manner, the amount of circumferential wrap can be adjusted.

DETAILED DESCRIPTION OF THE PREFERRED EMBODIMENT

Figure 1:
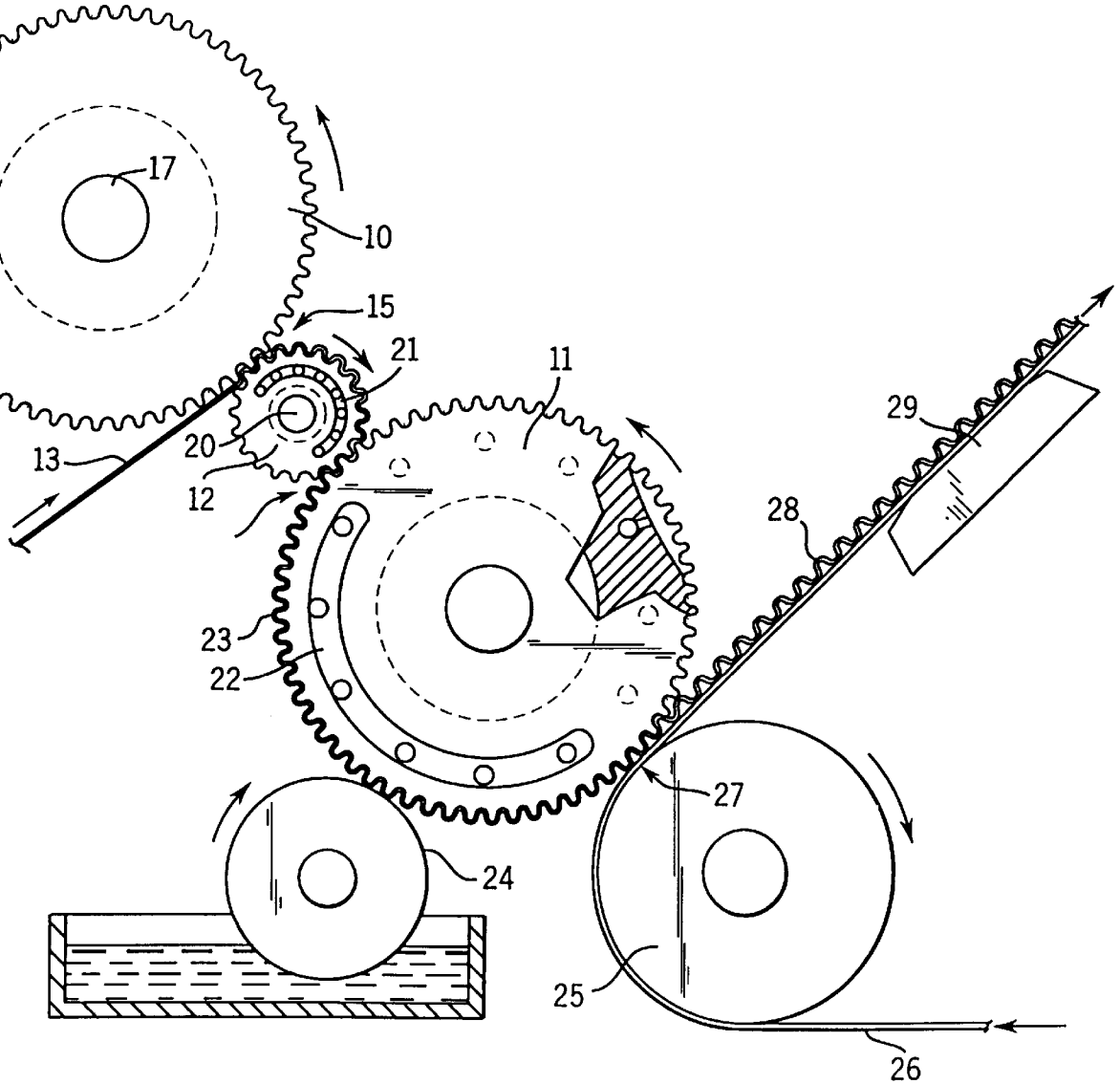
FIG. 1 is a schematic side elevation of a single facer incorporating the construction of the present invention.

In the single facer apparatus shown in FIG. 1, a conventional upper main corrugating roll 10 and lower main corrugating roll 11 are mounted in a modified position to capture therebetween and operate in rotating interengagement with a small intermediate corrugating roll 12. Each of the rolls 10–12 is provided with a conventional fluted peripheral surface with the flutes of each roll being of the same size, shape and pitch. In accordance with standards in the corrugated paperboard industry, flute configurations vary in terms of pitch dimension (number of flutes per foot) and flute depth (crown to root dimension). In the U.S., the configurations range from A-flute having 33 to 35 flutes per foot and a flute depth of 0.185 inch (4.7 mm) to E-flute having 90 to 96 flutes per foot and a flute depth of 0.045 inch (1.1 mm). A corresponding pitch dimension range from A-flute to E-flute is about ⅓ inch (approximately 8 mm) to about ⅛ inch (about 3 mm).

For many years, single facers have been made with a single pair of corrugating rolls, such as rolls 10 and 11 which were counterrotated to create a corrugating nip therebetween. A paper medium web 13 is fed directly into the nip and corrugated in the usual manner. Also until relatively recently, the diameters of the inter-engaging corrugated roll pair did not exceed about 12 inches (about 30 cm). However, as corrugator line speeds increased with a concomitant need to increase the speed of the single facer, corrugating roll diameters were increased to as large as 18 inches (about 46 cm) or more.

Figure 2:
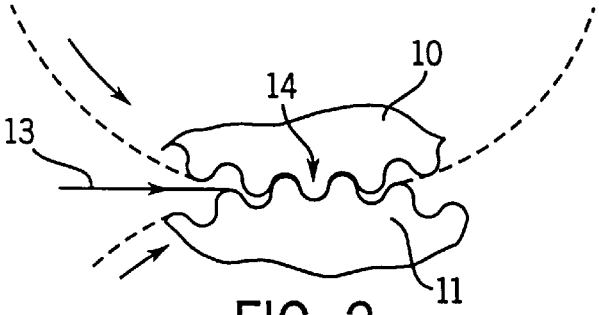
FIG. 2 PRIOR ART
FIG. 2 is a schematic representation of the labyrinth path in corrugating rolls of the prior art.
Figure 3:
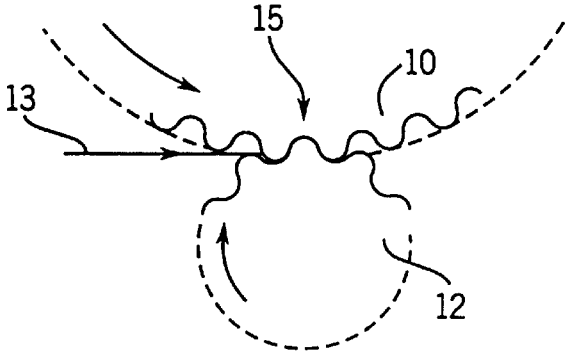
FIG. 3 is a schematic representation of the labyrinth path in the corrugating rolls of the present invention.

Referring also to FIGS. 2 and 3, there is shown schematically the generation of the so-called labyrinth path which the medium web 13 follows as it is pulled into the corrugating nip. Each of the FIGS. 2 and 3 illustrations utilizes interengaging corrugating rolls having flutes of the same pitch and shape, the only differences being in the diameter of one corrugating roll in each pair. FIG. 2 shows the medium web moving generally tangentially into the corrugating nip between two equal and relatively large diameter corrugating rolls, such as main rolls 10 and 11 in FIG. 1, if repositioned. As the diameter of a corrugating roll increases, its arc or pitch circle naturally tends to straighten or flatten. As the medium web 13 is drawn into the nip 14, it begins to be gathered and folded by contact with the flutes of both rolls upstream of the nip. Thus, before the web reaches its final corrugated flute shape at the centerline of the nip 14, it has already been subjected, in the illustrated embodiment, to some degree of folding or wrapping around three flute tips in addition to the fully interengaged flute tip pair at the nip. This is what is referred to in the industry as the labyrinth path. The wrapping of the web around each flute tip creates added tension in the web and these tension forces are additive. The forces are calculated in accordance with the function $e^{\mu\beta}$, where $\mu$ is the coefficient of friction and $\beta$ is the angle of wrap around the arcuate flute tip in radians. As corrugating roll diameters have increased to match corrugator speeds and nip loadings, the labyrinth paths have increased to the point where excess tension in the web often results in rupture of the medium web at the nip.

In accordance with the present invention, the interposition of the small diameter corrugating roll 12 between the upper and lower corrugating rolls 10 and 11 has the effect of considerably reducing the labyrinth path length and the corresponding build up of additive web tension. The modified single facer still utilizes larger high speed and high strength corrugating rollers which capture the small diameter intermediate roll 12 therebetween. As shown in FIG. 3, the length of the labyrinth path into the modified corrugating nip 15, formed by inter-engagement of the upper main corrugating roll 10 and the smaller diameter intermediate corrugating roll 12, is substantially reduced in length. As may be seen, the medium web 13 is partially wrapped on only two flute tips (in addition to the fully engaged pair at the nip 15) resulting in a labyrinth length significantly shorter than the length of the labyrinth in the FIG. 2 illustration. It is also believed that as the number of reverse bends imparted to the medium web as it travels through the serpentine labyrinth path increases with corrugating roll diameter increase, the problem of increasing tensile force on the web is compounded.

By maintaining the relatively large diameters of the upper and lower main corrugating rolls 10 and 11, high corrugating speeds and the resistance of the rolls to deflection may be retained. As shown in FIG. 1, the assembly of the three corrugating rolls 10–12 results in their rotational axes lying generally in a common plane. This plane also passes through the corrugating nip 15 and the corresponding nip 16 between the intermediate roll 12 and the lower corrugating roll 11. It should be noted that because the medium web 13 passing through nip 16 has already been corrugated, there is no labyrinth effect in nip 16. With main corrugating rolls 10 and 11 manufactured to larger diameters with inherently improved resistance to axial bending in the common plane, smaller and lower strength intermediate corrugating roll 12 is captured therebetween and held against axial bending or deformation in that plane. It is believed that the three roll assembly of the present invention may even allow the elimination of expensive crowned corrugating roll constructions. It is possible, if desired, to substantially increase the diameter of the upper corrugating roll 10 (and the lower corrugating roll 11 as well) to, for example, 24 inches (in excess of 60 cm). Correspondingly, the smaller intermediate corrugating roll 12 may have a diameter as small as 6 inches (about 15 cm), but may have a diameter of 8 inches (20 cm) or larger. It is believed that a ratio of diameters of upper corrugating roll 10 to intermediate corrugating roll 12 of at least about 3:1 is desirable. This ratio may, however, be varied considerably depending on overall medium web strength and roll speeds. Variation in flute type may also have some effect, but the benefits of labyrinth path length reduction provided by the subject invention are applicable to all flute types.

The remaining construction of the single facer utilizing the subject invention may be generally conventional. Thus, one or all of the corrugating rolls 10, 11 and 12 may be internally heated with steam, as through connections in their respective axial supporting shafts 17,18 and 20, all in a manner well known in the art. Preferably, both the intermediate corrugating roll 12 and the lower main corrugating roll 11 are provided with conventional vacuum systems by which vacuum is applied, via suitable networks of axial and radial vacuum passages 21 and 22, to the corrugated medium 23 wrapped thereon to help maintain its shape and position. The glue roll 24 of a conventional glue applicator makes rotating contact with the flute tips of the corrugated medium 23 on the lower corrugating roll 11. A liner web 26 is carried around a portion of a liner delivery roll 25 where it is brought into contact with the glued flute tips of the corrugated medium 23 in the pressure nip 27 formed by the liner delivery roll 25 and the lower corrugating roll 11. The liner delivery roll 25 may be of a conventional construction and positioned with its axis generally in the same plane as the axes of the corrugating rolls 10–12. Alternately, other pressure roll constructions may also be used, including a low pressure nip roll with supplemental curing of the resultant single face web 28 such as in downstream web heating device 29, as disclosed in my U.S. Pat. No. 5,600,900 entitled "Vacuum Assisted Web Drying System", issued Feb. 11, 1997; or my co-pending application entitled "Pressure Roll for a Single Facer" filed on the same date as this application.

Figure 5:
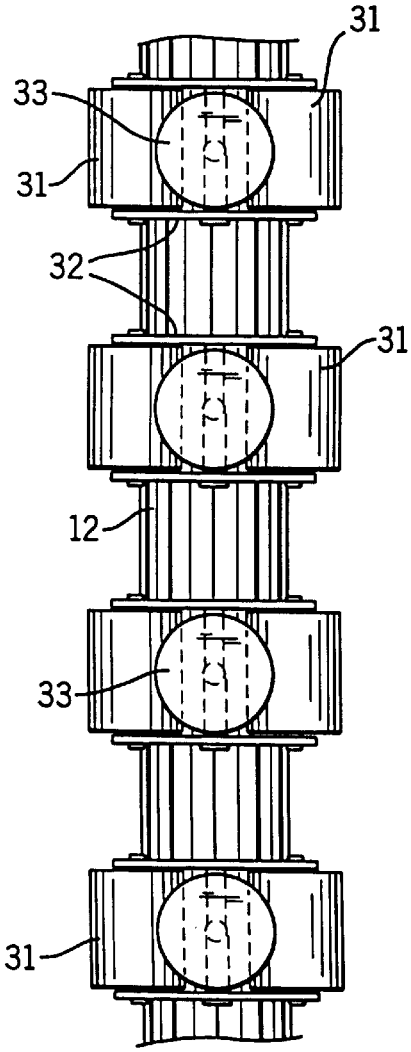
FIG. 5 is a generally top plan view taken on line 5—5 of FIG. 4.
Figure 4:
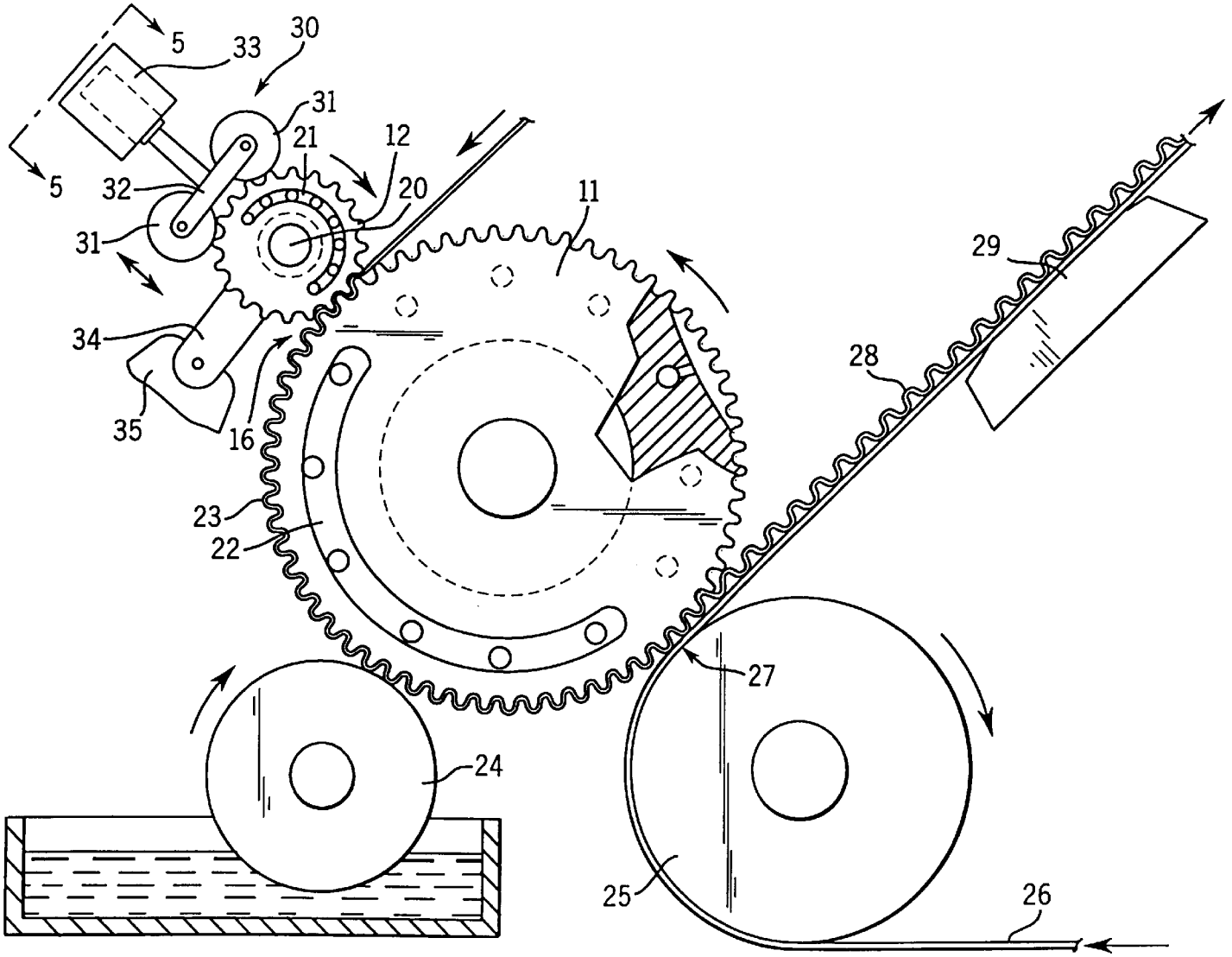
FIG. 4 is a schematic side elevation of a single facer incorporating the construction of the present invention.

Referring now to FIGS. 4 and 5, the small diameter intermediate corrugating roll 12 may be utilized in a modified single facer construction with only a lower corrugating roll 11 and with the upper corrugating roll of the previous embodiment replaced with a modified backing roll arrangement 30. In this presently preferred embodiment, the nip 16 between the small intermediate corrugating roll 12 and the larger diameter lower corrugating roll 11 becomes the corrugating nip. The medium web 13 is thus fed from a direction opposite the web in the FIG. 1 embodiment and directly into the nip 16. From that point, the corrugated medium 23 is handled in exactly the same manner as in the FIG. 1 embodiment.

To provide the necessary corrugating nip force, the backing roll arrangement 30 is positioned and operated to provide a downward force against the small corrugating roll 12, the resultant of which force acts through the corrugating nip generally in the plane common to the axes of both corrugating rolls 11 and 12. The backing roll arrangement 30 preferably applies a force along the full axial length of the small diameter corrugating roll 12 to provide a uniform nipping pressure or force and a uniform backing force which restrains the small corrugating roll against deflection normal to its axis.

The backing roll arrangement 30 includes a series of pairs of idler rolls 31, with each pair attached to a mounting bracket 32 such that the rolls are mounted on opposite sides of the common plane through the corrugating roll axes. The idler rolls 31 are positioned to bear directly on the outside of the fluted small diameter corrugating roll 12. The opposite axial ends of the small corrugating roll 12 are supported on the ends of a pair of pivot arms 34, the opposite ends of which are pivotally attached to the machine frame 35. Each idler roll pair includes a pneumatic cylinder 33 operatively attached to the mounting bracket 32 to impose a selectively variable force on the idler rolls and thus on the small corrugating roll 12.

The idler rolls 31 may comprise a hard rubber or rubber-like material to help reduce noise and vibration. The cylindrical outside surfaces of the idler rolls 31 may be smooth, as indicated, or may be provided with flutes to match the flute pattern of the corrugating roll 12 engaged by the idler rolls.

Although a plurality of pairs of idler rolls is preferred, as indicated, a pair of full length backing rolls could be used or a single full length roll positioned generally in the same manner as the large upper corrugating roll 10 of the FIG. 1 embodiment. The corrugating nip force and the force necessary to restrain the small corrugating roll against deflection may also be provided by an alternate backing means, such as an air bearing. In another embodiment, the intermediate corrugating roll 12 could be provided with a series of axially spaced annular grooves which interrupt the flute pattern and in which grooves narrow idler rolls (similar to roll pairs 31) are positioned to operate and provide the indicated backing force.

Figures 6, 7:
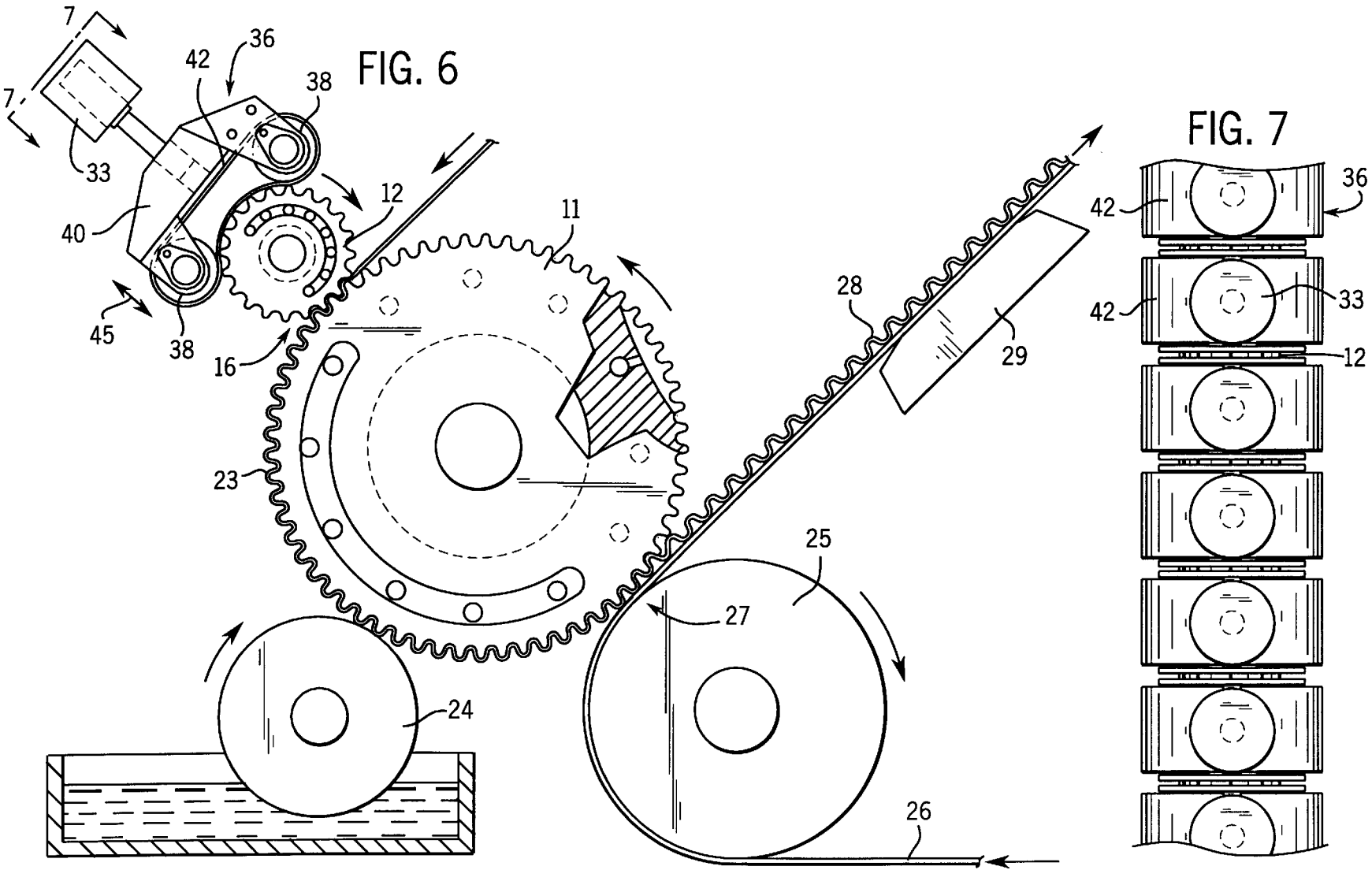
FIG. 6 is a schematic side elevation view of a single facer incorporating the construction of the presently preferred embodiment of the invention.
FIG. 7 is a generally top plan view taken on line 7—7 of FIG. 6.

Referring now to FIGS. 6 and 7, thereshown is a presently preferred embodiment of the invention. In the preferred embodiment, the small diameter corrugating roll 12 is utilized in a modified single facer construction with only a lower corrugating roll 11 and with the upper corrugating roll of the previous embodiment replaced with a modified backing roll arrangement 36. In a similar manner to the embodiment shown in FIG. 4, the nip 16 between the small diameter corrugating roll 12 and the larger diameter lower corrugating roll 11 becomes the corrugating nip.

To provide the necessary corrugating nip force, the backing roll arrangement 36 is positioned and operated to provide a downward force against the small diameter corrugating roll 12, the resultant of which force acts through the corrugating nip 16 generally in the plane common to the axes of both corrugating rolls 11 and 12. The backing roll arrangement 36 preferably applies a force along the full axial length of the small diameter corrugating roll 12 to provide a uniform nipping pressure or force and a uniform backing force which restrains the small corrugating roll against deflection normal to its axis.

The backing roll arrangement 36 generally includes a series of pairs of idler rolls 38, with each pair rotatably attached to a mounting bracket 40 such that the idler rolls 38 are mounted on opposite sides of the common plane through the corrugating roll axes. A pressure belt 42 is entrained around each pair of idler rolls 38 such that a portion of the pressure belt 42 is positioned on each side of the rotational axis of the air of idler rolls 38. Each pressure belt 42 is positioned to bear directly on the outside of the fluted small diameter corrugating roll 12 such that the backing roll arrangement 36 can apply a backing force to the small diameter corrugating roll 12 through the plurality of pressure belts 42. Each pressure belt 42 is entrained between a pair of idler rolls 38 with a sufficient amount of slack such that when the pressure belt 42 is moved into contact with the small diameter corrugation roll 12, the belt 42 contacts a portion of the outer circumference of roll 12. As can be understood by comparing the backing roll arrangement 36 shown in FIG. 6 with the backing roll arrangement 30 of FIG. 4, the pressure belt 42 increases the amount of surface contact with the small diameter corrugating roll 12 as compared to the pair of idler rolls 38 alone. This increased surface contact reduces the noise generated by the single facer and increases the effectiveness of the backing force provided by the backing roll arrangement 36.

The mounting bracket 40 is generally constructed to space the pair of idler rolls 38 such that the distance between the outer diameters of the idler rolls 38 is slightly less than the outer diameter of the small corrugating roll 12. Each idler roll pair includes a pneumatic cylinder 33 operatively attached to the mounting bracket 40 to impose a selectively variable force on the idler rolls 38 and pressure belt 40 and thus on the small corrugating roll 12. The pneumatic cylinder 33 can be operated to move the pressure belt 42 into and out of contact with the small diameter corrugating roll 12, as shown in phantom in FIG. 8 and by arrow 45.

When the pneumatic cylinder 33 is operated to move the idler rolls 38 and pressure belt 42 into contact with the small corrugating roll 12, the pressure belt 42 is pressed into contact with a portion of the fluted outer circumference of the small corrugating roll 12. Further pressure by the pneumatic cylinder 33 applies a greater amount of pressure to the small corrugating roll 12 through the pressure belt 42. Preferably, the pressure belt 42 is a standard fabric belt having sufficient strength to withstand constant pressure without failure. Alternatively, the pressure belt 42 could be fluted, such as by using an inverted timing belt, to match the small corrugating roll 12 such that the teeth of the pressure belt 40 would interact with the flutes on the small corrugating roll 12.

Referring now to FIG. 7, a plurality of backing roll arrangements 36 are positioned along the axial length of small corrugating roll 12, such that the plurality of backing roll arrangements 36 can supply a backing force along the entire axial length of small diameter corrugating roll 12. Since each of the backing roll arrangements 36 includes its own pneumatic cylinder 33, the backing roll arrangements 36 can be configured to be operated independently such that the backing force can be varied along the axial length of the small diameter corrugating roll 12.

The corrugated medium 23 exiting the corrugating nip 16 remains on the fluted surface of the corrugating roll 11, where the exposed flute tips are immediately coated with lines of adhesive by the glue roll 24 in a manner similar to the embodiments previously described. Downstream of the glue roll 24, a liner web 26 is brought into contact with the glued corrugated medium 23 on a liner delivery roll 25 around which the liner web 26 is wrapped and brought generally into tangential contact with the glued flute tips. As in the previously described embodiments, the liner delivery roll 25 is preferably spaced from the fluted outer surface of the corrugating roll 11 by a distance sufficient to preclude any significant nip pressure. The freshly glued single face web 28 reaches the heating device 29 which cures the glue bonds.

Figure 8:
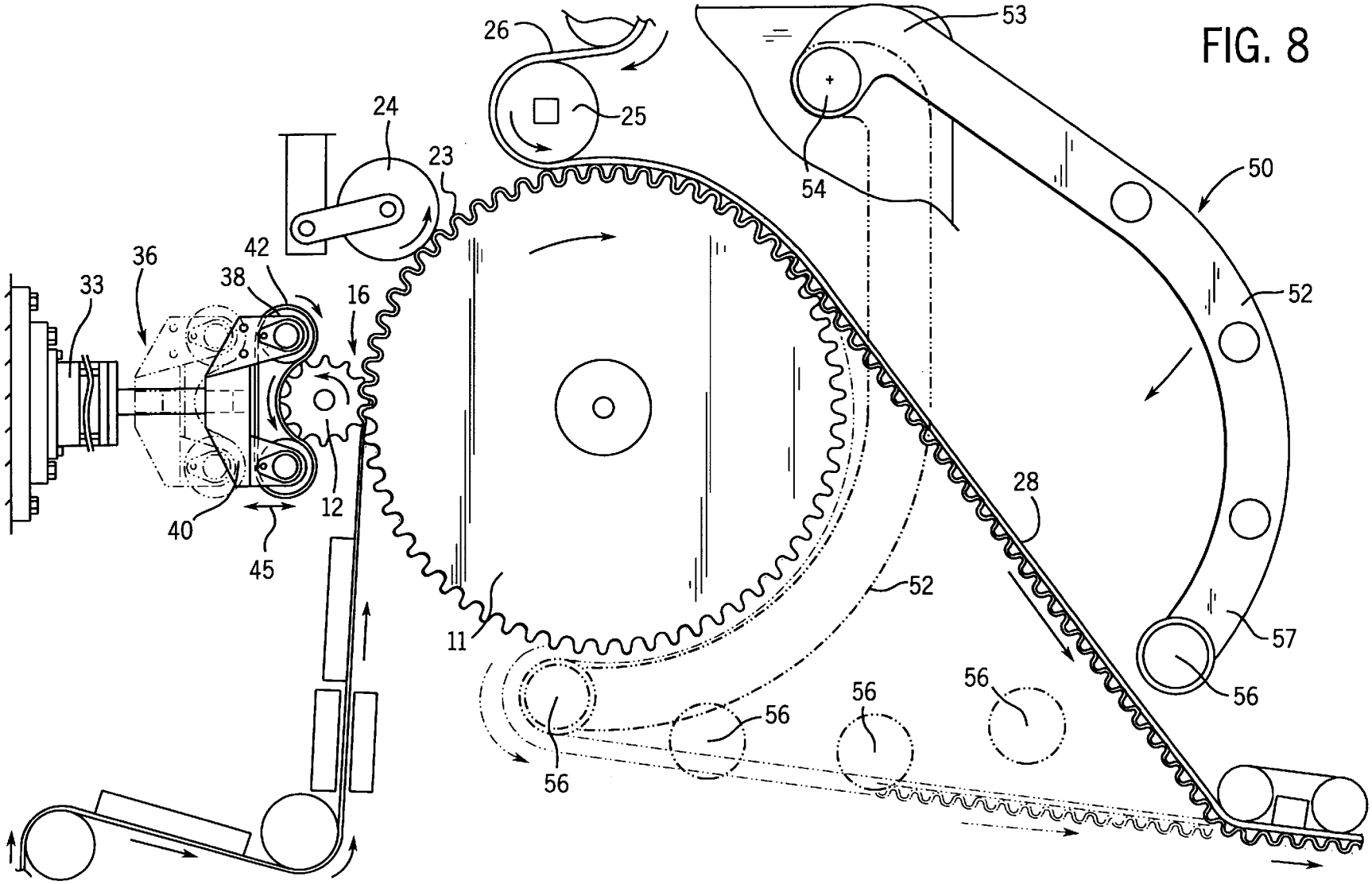
FIG. 8 is a schematic side elevation view of a single facer incorporating the wrap arm device of the presently preferred embodiment of the invention.

Referring now to FIG. 8, thereshown is an alternate construction for the preferred embodiment of the invention. In this embodiment, the freshly glued single face web 28 leaving the liner delivery roll 25 is maintained in contact with the heated corrugating roll 11 by a wrap arm device 50. The wrap arm device 50 allows the single face web to be adjustably wrapped around the circumferential portion of the large diameter corrugating roll 11 of a selected length or arc in a similar manner to the system disclosed in my copending application entitled Improved Low Pressure Single Facer, Ser. No. 08/856,662, now U.S. Pat. No. 5,628,865.

The wrap arm device 50 includes a pair of wrap arms 52 rotatably mounted at a first end 53 to a pivot connection 54. The pivot axis of the pivot connection 54 is spaced from the rotational axis of the large diameter corrugation roll 11 such that the wrap arm device 50 can move toward and away from the large diameter corrugating roll 11. The pivot connection 54 includes drive means capable of moving the wrap arms 52 between an extended position (shown in phantom) and a retracted position. An idler roll 56 is mounted to the second, opposite end 57 of each wrap arm 52 and extends the full axial length of the corrugating roll 11.

As shown in FIG. 8, the wrap arms 52 can pivot about the pivot connection 54 to move the idler roll 56 toward and away from the corrugating roll 11 along an arc generally shown in phantom. When the wrap arm device 50 is pivoted into its extended position (shown in phantom), the idler roll 56 is positioned in closely spaced relation to the fluted outer circumference of the large diameter corrugating roll 11 to maintain the single face web 28 in engagement with the fluted outer surface of the corrugating roll 11 for a maximum period of time. In the embodiment shown in FIG. 8, it can be seen that the single face web 28 remains in contact with the fluted outer surface of the heated corrugating roll 11 for approximately 180° of rotation after being formed by the pressure roll 25.

As the wrap arms 52 pivot from the extended position to the retracted position, the amount of contact between the freshly glued single face web 28 and the fluted outer surface of the corrugating roll 11 is decreased. Specifically, the single face web 28 extends between the outer circumference of the corrugating roll 11 and the idler roll 56 along a tangential path with respect to the outer circumference of the corrugating roll 11 to vary the amount of contact between the single face web 28 and the fluted surface of the corrugating roll 11. Thus, the wrap arm device 50 can be moved about the pivot connection 54 by the drive means to selectively adjust the amount of circumferential wrap of the single face web 28 on the corrugating roll 11. In the embodiment shown in FIG.8, the wrap arm device 50 can provide for somewhat more than 180° of wrap of a single face web 28 around the corrugating roll 11. From the idler roll 56 on the wrap arm 52, a single face web 28 is delivered to a downstream web drive from which it is carried to further downstream processing or storage, such as a conventional bridge storage area.

I claim:

1. A single facer apparatus for forming a single face corrugated web comprising:

a large diameter fluted corrugating roll;

a small diameter fluted corrugating roll positioned to interengage the large diameter roll to create therewith a corrugating nip; and a plurality of backing roll arrangements in rotatable engagement with the small diameter corrugating roll, each backing roll arrangement including a pair of idler rolls mounted on support assembly and a pressure belt entrained between the pair of idler rolls, and said backing roll arrangements positioned to apply a force along substantially the full axial length of the small diameter corrugating roll; and, an actuator operatively connected to each roll pair support assembly to impose a variable backing force on the backing roll arrangement to force the pressure belt into contact with the small diameter corrugating roll.

2. The apparatus as set forth in claim 1 wherein the large diameter corrugating roll is heated.

3. The apparatus as set forth in claim 1 wherein the actuator is a pneumatic cylinder.

4. The apparatus as set forth in claim 1 wherein the pressure belt includes flutes interengaging the flutes on the small diameter corrugating roll.

5. A single facer apparatus for producing a single face corrugated web from a medium web and a liner web, the apparatus comprising:

a large diameter fluted corrugating roll;

a small diameter fluted corrugating roll having a diameter not greater than about ⅓ the large diameter roll and positioned to interengage the large diameter roll to create therewith a corrugating nip; and a plurality of pressure belts each entrained between a pair of idler rolls, the plurality of pressure belts being positioned along the axial length of the smaller diameter fluted corrugating roll to apply a radial force to the small diameter roll along the axial length thereof, the resultant of said radial force creating a nip force acting through the corrugating nip to restrain the small diameter roll against deflection.

6. The apparatus as set forth in claim 5 further comprising:

a backing roll support assembly for each pair of idler rolls upon which one of the pressure belts is entrained; and an actuator operatively connected to each backing roll support assembly, the actuator supplying the required force to hold the pressure belt against the small diameter fluted corrugating roll.

7. The apparatus as set forth in claim 5 wherein the rolls of each pair of idler rolls are positioned on opposite sides of a common plane passing through the axes of rotation for the large diameter corrugating roll and the small diameter corrugating roll.

* * * * *